US012006813B2

(12) United States Patent
Hisham et al.

(10) Patent No.: US 12,006,813 B2
(45) Date of Patent: Jun. 11, 2024

(54) REAL-TIME CURVATURE ESTIMATION FOR AUTONOMOUS DIRECTIONAL DRILLING

(71) Applicant: Halliburton Energy Services, Inc., Houston, TX (US)

(72) Inventors: Khunsa Hisham, Houston, TX (US); Shahin Tasoujian, Houston, TX (US); Ketan C. Bhaidasna, Houston, TX (US); Yuanyan Chen, Houston, TX (US); Robert Darbe, Houston, TX (US); Vy Pho, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/587,991

(22) Filed: Jan. 28, 2022

(65) Prior Publication Data

US 2023/0243251 A1 Aug. 3, 2023

(51) Int. Cl.

| | |
|---|---|
| ***E21B 44/02*** | (2006.01) |
| ***E21B 7/04*** | (2006.01) |
| ***E21B 47/024*** | (2006.01) |

(52) U.S. Cl.

CPC ..... *E21B 44/02* (2013.01); *E21B 7/04* (2013.01); *E21B 47/024* (2013.01)

(58) Field of Classification Search

CPC ..... E21B 44/02; E21B 7/04; E21B 47/024

See application file for complete search history.

(56) References Cited

U.S. PATENT DOCUMENTS

| | | | |
|---|---|---|---|
| 5,220,963 | A | 6/1993 | Patton |
| 6,877,241 | B2 | 4/2005 | Barr et al. |

(Continued)

FOREIGN PATENT DOCUMENTS

| | | |
|---|---|---|
| CN | 110792430 | 2/2020 |
| WO | 2011-053364 | 5/2011 |

(Continued)

OTHER PUBLICATIONS

International Search Report and Written Opinion for Application No. PCT/US2022/015254, dated Oct. 14, 2022.

(Continued)

*Primary Examiner* — Dany E Akakpo

(74) *Attorney, Agent, or Firm* — Benjamin Ford; C. Tumey Law Group PLLC

(57) ABSTRACT

A method and system for estimating a wellbore curvature. The method may include disposing a rotary steerable system (RSS) into a borehole, storing a real-time curvature estimation for the borehole in an information handling system, wherein the information handling system is disposed on the RSS, taking a first attitude measurement at a first sensor, and taking a second attitude measurement at a second sensor. The method may further include applying a filter to at least the first attitude measurement and the second attitude measurement to form a filtered measurement set, performing a curvature estimation with the filtered measurement set to form an estimated curvature signal, comparing the estimated curvature signal to a curvature set point to find a difference, and adjusting at least one operating parameter of the RSS based on the difference.

20 Claims, 6 Drawing Sheets

(56) References Cited

U.S. PATENT DOCUMENTS

| | | | | |
|---|---|---|---|---|
| 9,347,308 | B2 | 5/2016 | Benson et al. | |
| 9,970,285 | B2 | 5/2018 | Sugiura | |
| 2004/0158997 | A1 | 8/2004 | Tang | |
| 2010/0100329 | A1* | 4/2010 | Ekseth | E21B 47/022 175/45 |
| 2019/0085680 | A1* | 3/2019 | Maus | E21B 47/024 |
| 2019/0169979 | A1 | 6/2019 | Nguyen et al. | |
| 2019/0292898 | A1 | 9/2019 | Quattrone et al. | |
| 2020/0072034 | A1 | 3/2020 | Zalluhoglu et al. | |
| 2020/0095849 | A1 | 3/2020 | Demirer et al. | |
| 2020/0095860 | A1 | 3/2020 | Zalluhoglu et al. | |
| 2020/0408084 | A1 | 12/2020 | Gu et al. | |
| 2021/0071477 | A1 | 3/2021 | Zhao et al. | |
| 2021/0103843 | A1 | 4/2021 | Keller et al. | |
| 2021/0238926 | A1 | 8/2021 | Zalluhoglu et al. | |
| 2021/0270088 | A1 | 9/2021 | Hornblower et al. | |
| 2022/0298910 | A1* | 9/2022 | Kolbe | E21B 7/06 |

FOREIGN PATENT DOCUMENTS

| | | | |
|---|---|---|---|
| WO | 2018102264 | A1 | 6/2018 |
| WO | 2021-016309 | | 1/2021 |
| WO | 2021168212 | A1 | 8/2021 |

OTHER PUBLICATIONS

Xue et al., "Continuous Real-Time Measurement of Drilling Trajectory With New State-Space Models of Kalman Filter", IEEE Transactions on Instrumentation and Measurement, vol. 65, No. 1, Jan. 2016, pp. 144-154.

Noureldin, Aboelmagd et al. "Measurement-while-drilling surveying of highly inclined and horizontal well sections utilizing single-axis gyro sensing system." Measurement Science and Technology, vol. 15, No. 12, Nov. 2004, pp. 2426-2434. PDF file. 11 pages.

* cited by examiner

REAL-TIME CURVATURE ESTIMATION FOR AUTONOMOUS DIRECTIONAL DRILLING

BACKGROUND

In order to obtain hydrocarbons such as oil and gas, boreholes are drilled through hydrocarbon-bearing subsurface formations. During drilling operations, directionally drilling operations may by performed where the drilling direction may veer of an intended drilling path at an angle or even horizontally away from the drilling path. Directional drilling of a subterranean well may be relatively complex and involve considerable expense. Most of these operations are done by hand with experienced operators running the drilling platform. There is a continual effort in the industry to develop improvement in safety, cost minimization, and efficiency. The advancements of computerized and automated systems in drilling processes are the next step in achieving these goals.

One such goal may be measuring or estimating real-time wellbore curvature (build rate and walk/turn rate) during drilling operations. Currently, other than survey measurements for wellbore curvature, there is no other reliable and more frequent estimation approach to compute the real-time curvature (inclination and azimuth variation rates). There are two major challenges associated with real-time wellbore/borehole curvature estimation.

First, real-time high-frequency attitude (inclination and azimuth) measurements acquired by downhole sensors may be noisy and corrupted, and thus, require processing due to drilling vibrations, biases on sensors, saturation on sensors, etc. As a result, the simple method of taking the time/depth derivative of attitude signals will fail to calculate the instantaneous curvature value.

Second, in directional drilling systems, the curvature is often measured or calculated in the depth domain which requires depth information. Real-time depth information is often not available downhole at the bottom hole assembly (BHA) while drilling, and it's only accessible on the surface using pipe tally data. Even though depth information may be downlinked to the downhole BHA, the limited bandwidth of the telemetry system may cause a large time delay and therefore will make the downlinking depth ineffective approach.

BRIEF DESCRIPTION OF THE DRAWINGS

These drawings illustrate certain aspects of some examples of the present disclosure and should not be used to limit or define the disclosure.

DETAILED DESCRIPTION

Described below are methods and systems for estimating the wellbore curvature in real time using the available information from one or more sensors disposed on a bottom hole assembly (BHA). To estimate wellbore curvature, data supplied from a database or the one or more sensors disposed on the bottom hole assembly may be utilized as curvature information. Curvature information is useful information to accurately control the trajectory of the borehole during the drilling operations. The proposed method provides smooth and reliable real-time curvature estimation while reducing computational power. Additionally, an adaptive Kalman filter may be used during this processing to reduce error in estimation. The proposed methods discussed below may be applied for both surface and downhole drilling automation scenarios (drilling advisory systems) in the directional drilling assembly. Systems implemented with the methods describe below may include at least two attitude sensors longitudinally mounted along the axis of a bottom hole assembly (BHA). As discussed below, the attitude sensors may be disposed on the BHA with a known distance between each attitude sensor. For example, an attitude sensor may be disposed at, on, adjacent to, or close to the drill bit, and another may be disposed at a distance behind the drill bit. As such, methods may be utilized an advanced error estimation block to deal with the complex working condition of the BHA/bit downhole and estimate/compute reliable real-time curvature data while drilling.

Attitude and curve control are a challenging part of drilling automation to fulfill the full autonomy in directional drilling systems. During directional drilling operations, one goal may be to drill a section with a constant curvature close to a target curvature. The target curvature (i.e., curvature set point) may be set based on the well plan or a desired curvature value defined by the user. Hence, the quality and the accuracy of curvature signals (build rate and turn/walk rate) may considerably affect the control performance (closeness of real-time drilled wellbore to the well plan). Therefore, having a fast, reliable, and accurate algorithm to estimate the real-time wellbore curvature signal has great importance in directional drilling advisory systems (drilling automation and control).

Figure 1:
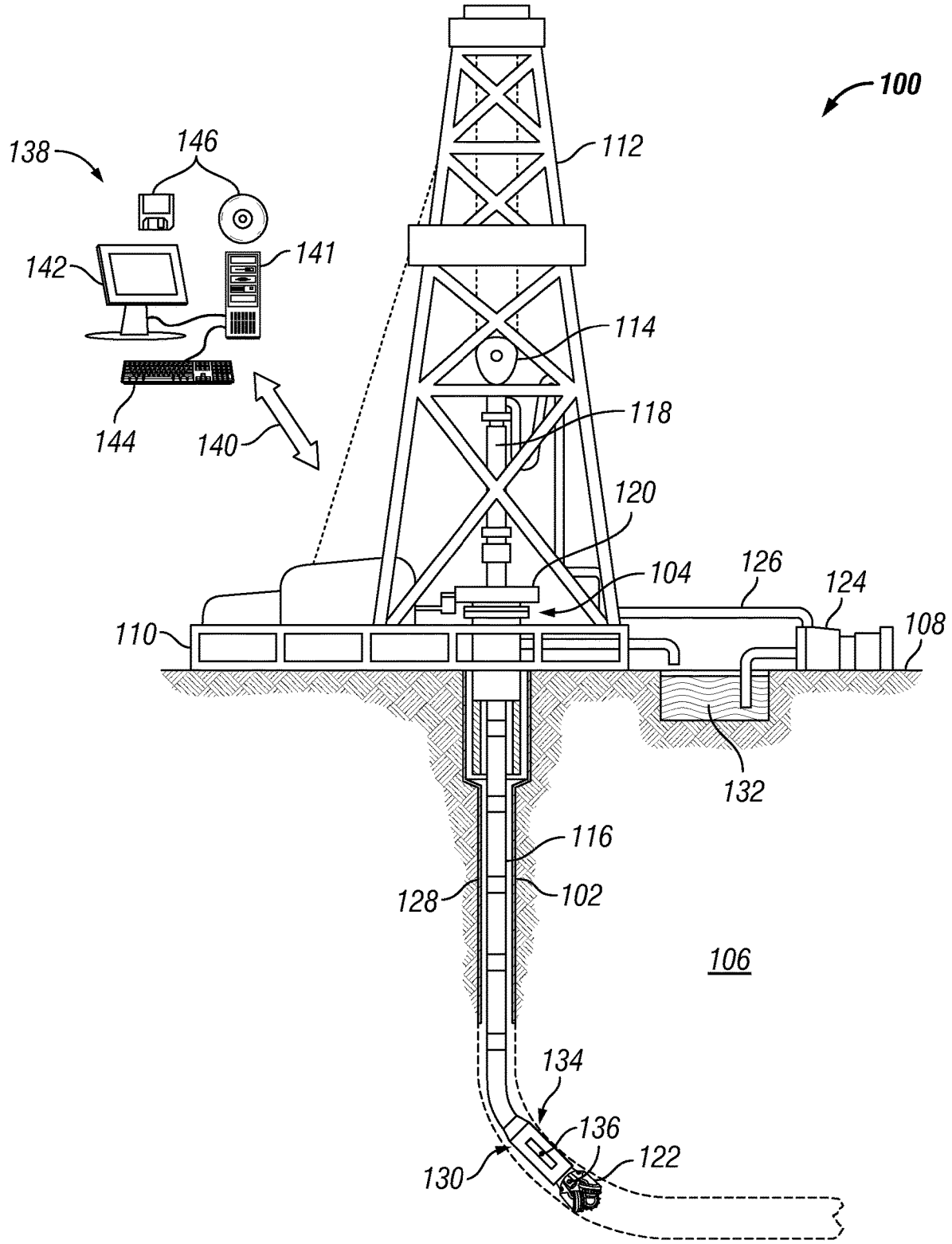
FIG. 1 illustrate an example of a drilling system.

FIG. 1 illustrates a drilling system 100 in accordance with example embodiments. As illustrated, borehole 102 may extend from a wellhead 104 into a subterranean formation 106 from a surface 108. Generally, borehole 102 may include horizontal, vertical, slanted, curved, and other types of borehole geometries and orientations. Borehole 102 may be cased or uncased. In examples, borehole 102 may include a metallic member. By way of example, the metallic member may be a casing, liner, tubing, or other elongated steel tubular disposed in borehole 102.

As illustrated, borehole 102 may extend through subterranean formation 106. As illustrated in FIG. 1, borehole 102 may extend generally vertically into the subterranean formation 106, however borehole 102 may extend at an angle through subterranean formation 106, such as horizontal and slanted boreholes. For example, although FIG. 1 illustrates a vertical or low inclination angle well, high inclination angle or horizontal placement of the well and equipment may be possible. It should further be noted that while FIG. 1 generally depict land-based operations, those skilled in the art may recognize that the principles described herein are equally applicable to subsea operations that employ floating or sea-based platforms and rigs, without departing from the scope of the disclosure.

As illustrated, a drilling platform 110 may support a derrick 112 having a traveling block 114 for raising and lowering drill string 116. Drill string 116 may include, but is not limited to, drill pipe and coiled tubing, as generally known to those skilled in the art. A kelly 118 may support drill string 116 as it may be lowered through a rotary table 120. A drill bit 122 may be attached to the distal end of drill string 116 and may be driven either by a downhole motor and/or via rotation of drill string 116 from surface 108. Without limitation, drill bit 122 may include, roller cone bits, PDC bits, natural diamond bits, any hole openers, reamers, coring bits, and the like. As drill bit 122 rotates, it may create and extend borehole 102 that penetrates various subterranean formations 106. A pump 124 may circulate drilling fluid through a feed pipe 126 through kelly 118, downhole through interior of drill string 116, through orifices in drill bit 122, back to surface 108 via annulus 128 surrounding drill string 116, and into a retention pit 132.

With continued reference to FIG. 1, drill string 116 may begin at wellhead 104 and may traverse borehole 102. Drill bit 122 may be attached to a distal end of drill string 116 and may be driven, for example, either by a downhole motor and/or via rotation of drill string 116 from surface 108. Drill bit 122 may be a part of a rotary steerable system (RSS) 130 at distal end of drill string 116. RSS 130 may further include tools for real-time health assessment of a rotary steerable tool during drilling operations. As will be appreciated by those of ordinary skill in the art, RSS 130 may be a measurement-while drilling (MWD) or logging-while-drilling (LWD) system.

RSS 130 may comprise any number of tools, such as sensors, transmitters, and/or receivers to perform downhole measurement operations or to perform real-time health assessment of a rotary steerable tool during drilling operations. For example, as illustrated in FIG. 1, RSS 130 may include a bottom hole assembly (BHA) 134. It should be noted that BHA 134 may make up at least a part of RSS 130. Without limitation, any number of different measurement assemblies, communication assemblies, battery assemblies, and/or the like may form RSS 130 with BHA 134. Additionally, BHA 134 may form RSS 130 itself. In examples, BHA 134 may comprise one or more sensors 136. Sensors 136 may be connected to information handling system 138, discussed below. Information handling system 138 may use the measurements taken by sensors 136 to form a curvature estimation of borehole 102 in real-time. For this disclosure sensors 136 may be attitude sensors. Attitude sensors may function and operate to provide attitude information, such as inclination or azimuth. In examples, sensors 136 may be gyro-based and allow for detection of rotational velocity and utilizing integration may allow for angle measurements to be found form the gyro-based measurements. As noted above, sensors 136 may be disposed on drill bit 122 and/or along BHA 134 at any suitable location. During operations, sensors 136 may process real-time data originating from various sources such as diagnostics data, sensors measurements, operational data, and/or the like. Information and/or measurements may be processed further by information handling system 138 to determine real-time curvature created during directional drilling operations.

Without limitation, RSS 130 may be connected to and/or controlled by information handling system 138, which may be disposed on surface 108. Without limitation, information handling system 138 may be disposed downhole in RSS 130. Processing of information recorded may occur downhole and/or on surface 108. Processing occurring downhole may be transmitted to surface 108 to be recorded, observed, and/or further analyzed. Additionally, information recorded on information handling system 138 that may be disposed downhole may be stored until RSS 130 may be brought to surface 108. In examples, information handling system 138 may communicate with RSS 130 through a communication line (not illustrated) disposed in (or on) drill string 116. In examples, wireless communication may be used to transmit information back and forth between information handling system 138 and RSS 130. Information handling system 138 may transmit information to RSS 130 and may receive as well as process information recorded by RSS 130. In examples, a downhole information handling system (not illustrated) may include, without limitation, a microprocessor or other suitable circuitry, for estimating, receiving and processing signals from RSS 130. Downhole information handling system (not illustrated) may further include additional components, such as memory, input/output devices, interfaces, and the like. In examples, while not illustrated, RSS 130 may include one or more additional components, such as analog-to-digital converter, filter and amplifier, among others, which may be used to process the measurements of RSS 130 before they may be transmitted to surface 108. Alternatively, raw measurements from RSS 130 may be transmitted to surface 108.

Any suitable technique may be used for transmitting signals from RSS 130 to surface 108, including, but not limited to, wired pipe telemetry, mud-pulse telemetry, acoustic telemetry, and electromagnetic telemetry. While not illustrated, RSS 130 may include a telemetry subassembly that may transmit telemetry data to surface 108. At surface 108, pressure transducers (not shown) may convert the pressure signal into electrical signals for a digitizer (not illustrated). The digitizer may supply a digital form of the telemetry signals to information handling system 138 via a communication link 140, which may be a wired or wireless link. The telemetry data may be analyzed and processed by information handling system 138.

As illustrated, communication link 140, which may be wired, wireless, mud pulse communication, or any other suitable form of communication known in the art, may be provided that may transmit data from RSS 130 to an information handling system 138 at surface 108. Information handling system 138 may include a personal computer 141, a video display 142, a keyboard 144 (i.e., other input devices), and/or non-transitory computer-readable media 146 (e.g., optical disks, magnetic disks) that can store code representative of the methods described herein. In addition to, or in place of processing at surface 108, processing may occur downhole as information handling system 138 may be disposed on RSS 130. Likewise, information handling system 138 may process measurements taken by one or more sensors 136 automatically or send information from sensors 136 to the surface 108. As discussed above, the software, algorithms, and modeling are performed by information handling system 138. Information handling system 138 may perform steps, run software, perform calculations, and/or the like automatically, through automation, such as through artificial intelligence ("AI"), dynamically, in real-time, and/or substantially in real-time.

Figure 2:
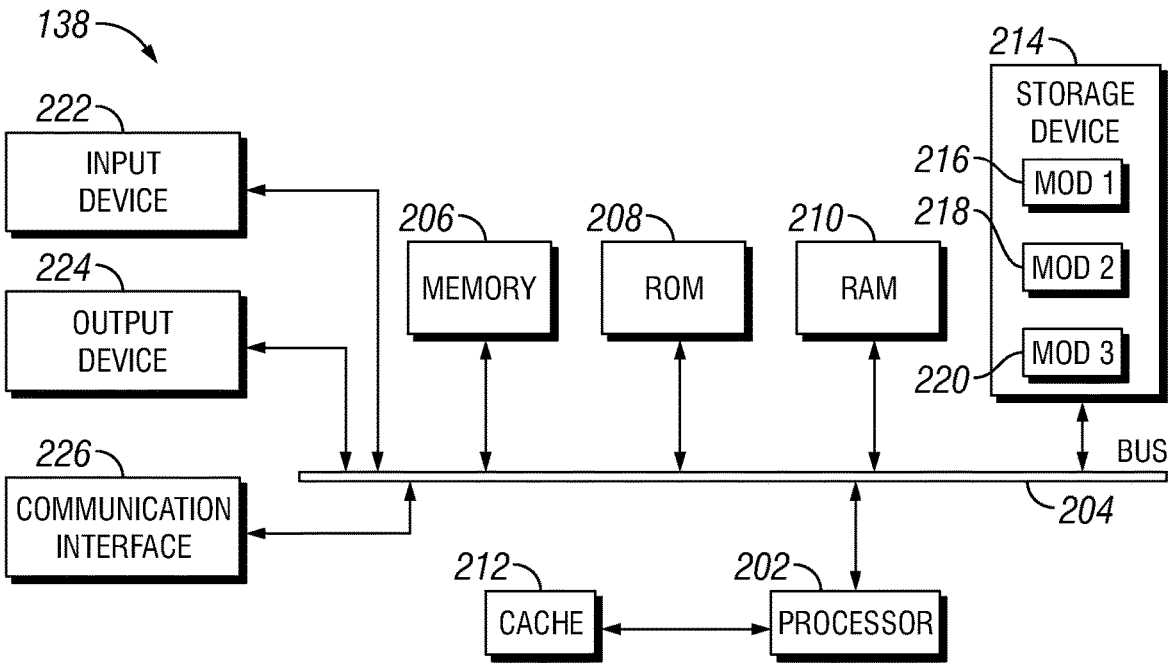
FIG. 2 is a schematic view of an information handling system.

FIG. 2 illustrates an example information handling system 138 which may be employed to perform various steps, methods, and techniques disclosed herein in accordance with some embodiments. Persons of ordinary skill in the art will readily appreciate that other system examples are possible. As illustrated, information handling system 138 includes a processing unit (CPU or processor) 202 and a system bus 204 that couples various system components including system memory 206 such as read only memory (ROM) 208 and random access memory (RAM) 210 to processor 202. Processors disclosed herein may all be forms of this processor 202. Information handling system 138 may include a cache 212 of high-speed memory connected directly with, in close proximity to, or integrated as part of processor 202. Information handling system 138 copies data from memory 206 and/or storage device 214 to cache 212 for quick access by processor 202. In this way, cache 212 provides a performance boost that avoids processor 202 delays while waiting for data. These and other modules may control or be configured to control processor 202 to perform various operations or actions. Other system memory 206 may be available for use as well. Memory 206 may include multiple different types of memory with different performance characteristics. It may be appreciated that the disclosure may operate on information handling system 138 with more than one processor 202 or on a group or cluster of computing devices networked together to provide greater processing capability. Processor 202 may include any general purpose processor and a hardware module or software module, such as first module 216, second module 218, and third module 220 stored in storage device 214, configured to control processor 202 as well as a special-purpose processor where software instructions are incorporated into processor 202. Processor 202 may be a self-contained computing system, containing multiple cores or processors, a bus, memory controller, cache, etc. A multi-core processor may be symmetric or asymmetric. Processor 202 may include multiple processors, such as a system having multiple, physically separate processors in different sockets, or a system having multiple processor cores on a single physical chip. Similarly, processor 202 may include multiple distributed processors located in multiple separate computing devices but working together such as via a communications network. Multiple processors or processor cores may share resources such as memory 206 or cache 212 or may operate using independent resources. Processor 202 may include one or more state machines, an application specific integrated circuit (ASIC), or a programmable gate array (PGA) including a field PGA (FPGA).

Each individual component discussed above may be coupled to system bus 204, which may connect each and every individual component to each other. System bus 204 may be any of several types of bus structures including a memory bus or memory controller, a peripheral bus, and a local bus using any of a variety of bus architectures. A basic input/output (BIOS) stored in ROM 208 or the like, may provide the basic routine that helps to transfer information between elements within information handling system 138, such as during start-up. Information handling system 138 further includes storage devices 214 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. Storage device 214 may include software modules 216, 218, and 220 for controlling processor 202. Information handling system 138 may include other hardware or software modules. Storage device 214 is connected to the system bus 204 by a drive interface. The drives and the associated computer-readable storage devices provide nonvolatile storage of computer-readable instructions, data structures, program modules and other data for information handling system 138. In one aspect, a hardware module that performs a particular function includes the software component stored in a tangible computer-readable storage device in connection with the necessary hardware components, such as processor 202, system bus 204, and so forth, to carry out a particular function. In another aspect, the system may use a processor and computer-readable storage device to store instructions which, when executed by the processor, cause the processor to perform operations, a method or other specific actions. The basic components and appropriate variations may be modified depending on the type of device, such as whether information handling system 138 is a small, handheld computing device, a desktop computer, or a computer server. When processor 202 executes instructions to perform "operations", processor 202 may perform the operations directly and/or facilitate, direct, or cooperate with another device or component to perform the operations.

As illustrated, information handling system 138 employs storage device 214, which may be a hard disk or other types of computer-readable storage devices which may store data that are accessible by a computer, such as magnetic cassettes, flash memory cards, digital versatile disks (DVDs), cartridges, random access memories (RAMs) 210, read only memory (ROM) 208, a cable containing a bit stream and the like, may also be used in the exemplary operating environment. Tangible computer-readable storage media, computer-readable storage devices, or computer-readable memory devices, expressly exclude media such as transitory waves, energy, carrier signals, electromagnetic waves, and signals per se.

To enable user interaction with information handling system 138, an input device 222 represents any number of input mechanisms, such as a microphone for speech, a touch-sensitive screen for gesture or graphical input, keyboard, mouse, motion input, speech and so forth. Additionally, input device 222 may take in data from one or more sensors 136, discussed above. An output device 224 may also be one or more of a number of output mechanisms known to those of skill in the art. In some instances, multimodal systems enable a user to provide multiple types of input to communicate with information handling system 138. Communications interface 226 generally governs and manages the user input and system output. There is no restriction on operating on any particular hardware arrangement and therefore the basic hardware depicted may easily be substituted for improved hardware or firmware arrangements as they are developed.

As illustrated, each individual component describe above is depicted and disclosed as individual functional blocks. The functions these blocks represent may be provided through the use of either shared or dedicated hardware, including, but not limited to, hardware capable of executing software and hardware, such as a processor 202, that is purpose-built to operate as an equivalent to software executing on a general purpose processor. For example, the functions of one or more processors presented in FIG. 2 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 208 for storing software performing the operations described below, and random access memory (RAM) 210 for storing results. Very large scale integration (VLSI) hardware embodiments, as well as custom VLSI circuitry in combination with a general purpose DSP circuit, may also be provided.

The logical operations of the various methods, described below, are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. Information handling system 138 may practice all or part of the recited methods, may be a part of the recited systems, and/or may operate according to instructions in the recited tangible computer-readable storage devices. Such logical operations may be implemented as modules configured to control processor 202 to perform particular functions according to the programming of software modules 216, 218, and 220.

Figure 3:
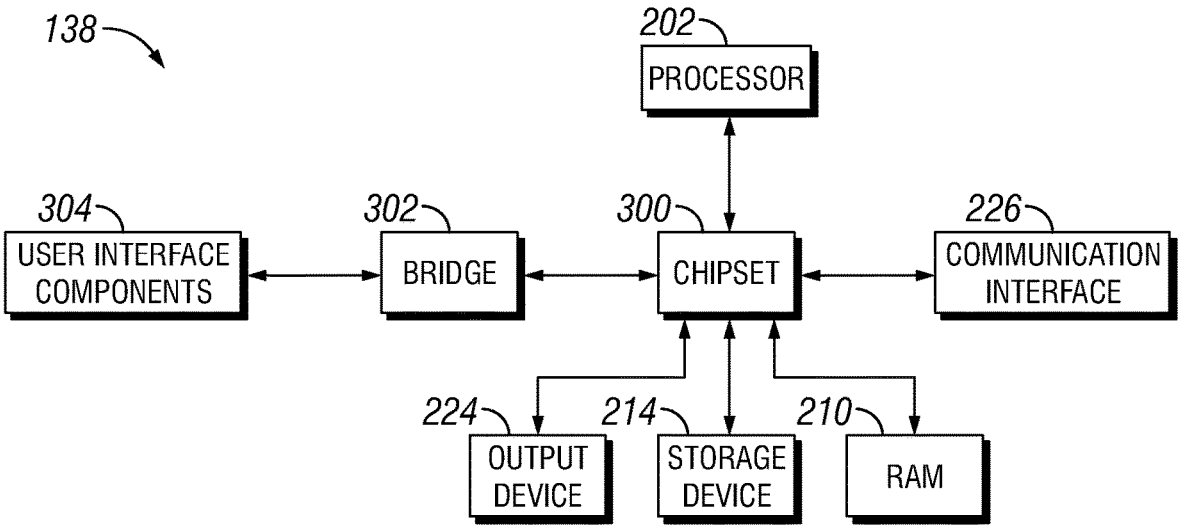
FIG. 3 is another schematic view of the information handling system.

In examples, one or more parts of the example information handling system 138, up to and including the entire information handling system 138, may be virtualized. For example, a virtual processor may be a software object that executes according to a particular instruction set, even when a physical processor of the same type as the virtual processor is unavailable. A virtualization layer or a virtual "host" may enable virtualized components of one or more different computing devices or device types by translating virtualized operations to actual operations. Ultimately however, virtualized hardware of every type is implemented or executed by some underlying physical hardware. Thus, a virtualization compute layer may operate on top of a physical compute layer. The virtualization compute layer may include one or more virtual machines, an overlay network, a hypervisor, virtual switching, and any other virtualization application FIG. 3 illustrates an example information handling system 138 having a chipset architecture that may be used in executing the described method and generating and displaying a graphical user interface (GUI) in accordance with some embodiments. Information handling system 138 is an example of computer hardware, software, and firmware that may be used to implement the disclosed technology. Information handling system 138 may include a processor 202, representative of any number of physically and/or logically distinct resources capable of executing software, firmware, and hardware configured to perform identified computations. Processor 202 may communicate with a chipset 300 that may control input to and output from processor 202. In this example, chipset 300 outputs information to output device 224, such as a display, and may read and write information to storage device 214, which may include, for example, magnetic media, and solid state media. Chipset 300 may also read data from and write data to RAM 210. A bridge 302 for interfacing with a variety of user interface components 304 may be provided for interfacing with chipset 300. Such user interface components 304 may include a keyboard, a microphone, touch detection and processing circuitry, a pointing device, such as a mouse, and so on. In general, inputs to information handling system 138 may come from any of a variety of sources, machine generated and/or human generated.

Chipset 300 may also interface with one or more communication interfaces 226 that may have different physical interfaces. Such communication interfaces may include interfaces for wired and wireless local area networks, for broadband wireless networks, as well as personal area networks. Some applications of the methods for generating, displaying, and using the GUI disclosed herein may include receiving ordered datasets over the physical interface or be generated by the machine itself by processor 202 analyzing data stored in storage device 214 or RAM 210. Further, information handling system 138 receive inputs from a user via user interface components 304 and execute appropriate functions, such as browsing functions by interpreting these inputs using processor 202.

In examples, information handling system 138 may also include tangible and/or non-transitory computer-readable storage devices for carrying or having computer-executable instructions or data structures stored thereon. Such tangible computer-readable storage devices may be any available device that may be accessed by a general purpose or special purpose computer, including the functional design of any special purpose processor as described above. By way of example, and not limitation, such tangible computer-readable devices may include RAM, ROM, EEPROM, CD-ROM or other optical disk storage, magnetic disk storage or other magnetic storage devices, or any other device which may be used to carry or store desired program code in the form of computer-executable instructions, data structures, or processor chip design. When information or instructions are provided via a network, or another communications connection (either hardwired, wireless, or combination thereof), to a computer, the computer properly views the connection as a computer-readable medium. Thus, any such connection is properly termed a computer-readable medium. Combinations of the above should also be included within the scope of the computer-readable storage devices.

Computer-executable instructions include, for example, instructions and data which cause a general purpose computer, special purpose computer, or special purpose processing device to perform a certain function or group of functions. Computer-executable instructions also include program modules that are executed by computers in standalone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

In additional examples, methods may be practiced in network computing environments with many types of computer system configurations, including personal computers, hand-held devices, multi-processor systems, microprocessor-based or programmable consumer electronics, network PCs, minicomputers, mainframe computers, and the like. Examples may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices During drilling operations information handling system 138 may process different types of the real-time data originated from varied sampling rates and various sources, such as diagnostics data, sensor measurements, operations data, and or the like through one or more sensors 136 disposed at any suitable location within and/or on RSS 130 (e.g., referring to FIG. 1).

For this disclosure, in real-time is defined as an order of milliseconds or microseconds. Thus, measurements, processing, and/or correction to RSS 130 trajectory may be performed in millisecond or microseconds. These measurements from one or more sensors 136 may allow for information handling system 138 to form curvature estimation in real-time for during drilling operation while drilling a curve section of borehole 102 (e.g., referring to FIG. 1).

Figure 4:
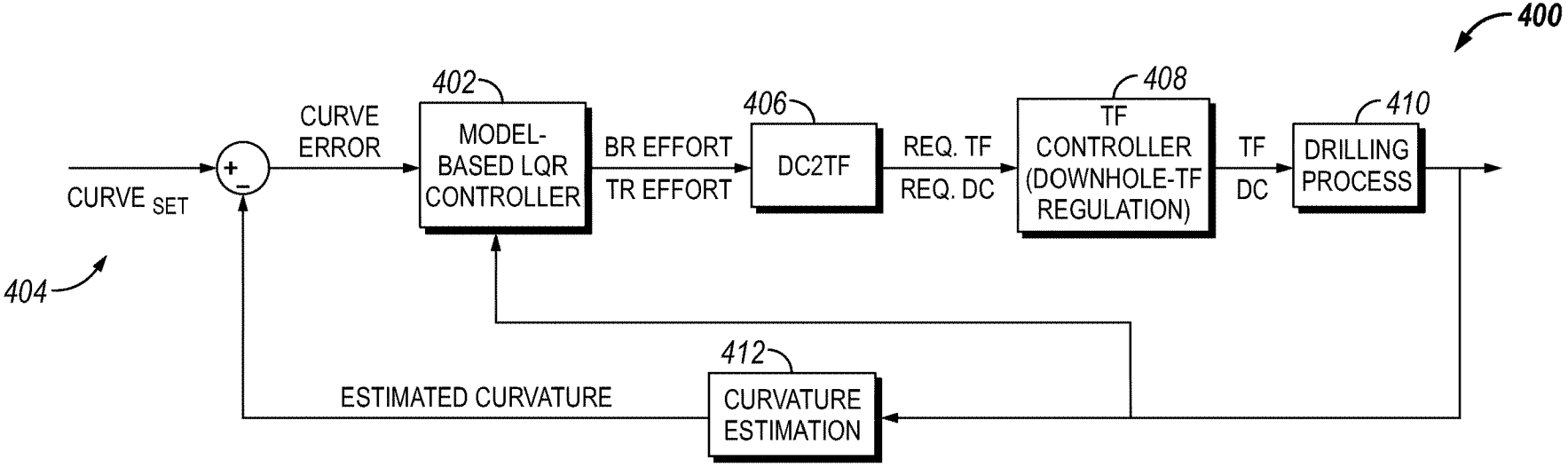
FIG. 4 illustrates a feedback loop for directional drilling operations.

FIG. 4 illustrates workflow 400, which may be implemented on information handling system 138 (e.g., referring got FIG. 1). In examples, workflow 400 may be implemented at the surface 108 (e.g., referring got FIG. 1) or downhole with information handling system 138 disposed on BHA 134 (e.g., referring got FIG. 1), or performed on two or more information handling systems 138 disposed at surface 108 and/or on BHA 134. Data transportation and communication bandwidth between each information handling system 138 may control the ability of information handling system 138 to perform real-time curvature estimation. Therefore, acquiring the high-frequency data and running the methods discussed below on an information handling system 138 disposed on BHA 134 may improve the speed in which real-time curvature estimation may be performed.

As noted above, information handling system 138 may include any number of computers 141 (e.g., referring got FIG. 1) disposed at any location and may communicate to one another on a network. Workflow 400 may begin with block 402, in which a curvature controller may use a curvature error signal as an input. The curvature error signal may be found as the difference between the curvature set point (i.e., $\text{Curve}_{set}$) 404 and estimated curvature output from curvature estimation in block 412. $\text{Curve}_{set}$ 404 is defined as the target curvature (i.e., curvature set point), which is set based on the well plan or a desired curvature value defined by the user. For example, to determine the target curvature in the inclination plane, the target build rate is calculated as the depth-based derivative of inclination targets. In block 402, the curvature controller may provide control recommendation to drive RSS 130 (e.g., referring to FIG. 1) to achieve the curvature set point $\text{Curve}_{set}$ 404. During drilling operations, a curvature controller in block 402 may constantly alter, in real-time, the direction of RSS 130 to achieve the curvature set point $\text{Curve}_{set}$ 404.

The outputs of curvature controller in block 402 may be utilized as an input into blocks 408 and 410. Outputs of block 402 may be one or more duty cycles (DC) and/or tool face (TF) commands. As illustrated in FIG. 4, one or more DC commands may be an input for block 410. Likewise, one or more TF commands may be sent to block 408. Block 408 may comprise a Tool Face (TF) controller that is a part of information handling system 138. TF controller may be operable to transmit TF instruction from block 408 to control the direction and/or orientation of RSS 130. These TF and DC instructions may alter the direction of RSS 130 in real-time during drilling operations, discussed above in FIG. 1, in block 410. During drilling operations in block 410, one or more sensors 136 may take attitude measurements in block 410, which may be sent to block 412 for curvature estimation. Estimated curvature may then be used to update the input into block 402 and workflow 400 may be repeated continuously and in real-time during drilling operations.

With continued reference to block 412, methods and systems may process the attitude measurements acquired by one or more sensors 136 located separately on BHA 134 (with a known distance, L). In examples, a first sensor 136 may be disposed proximal to, on, and/or near drill bit 122. A second sensor 136 may be disposed at a length, L, away from the first sensor 136 at any location on BHA 134. This may allow for wellbore attitude measurements to be taken in real-time. Therefore, wellbore attitude measurements from the two sensors 136 may be utilized and processed to estimate wellbore curvature in real-time.

Figure 5:
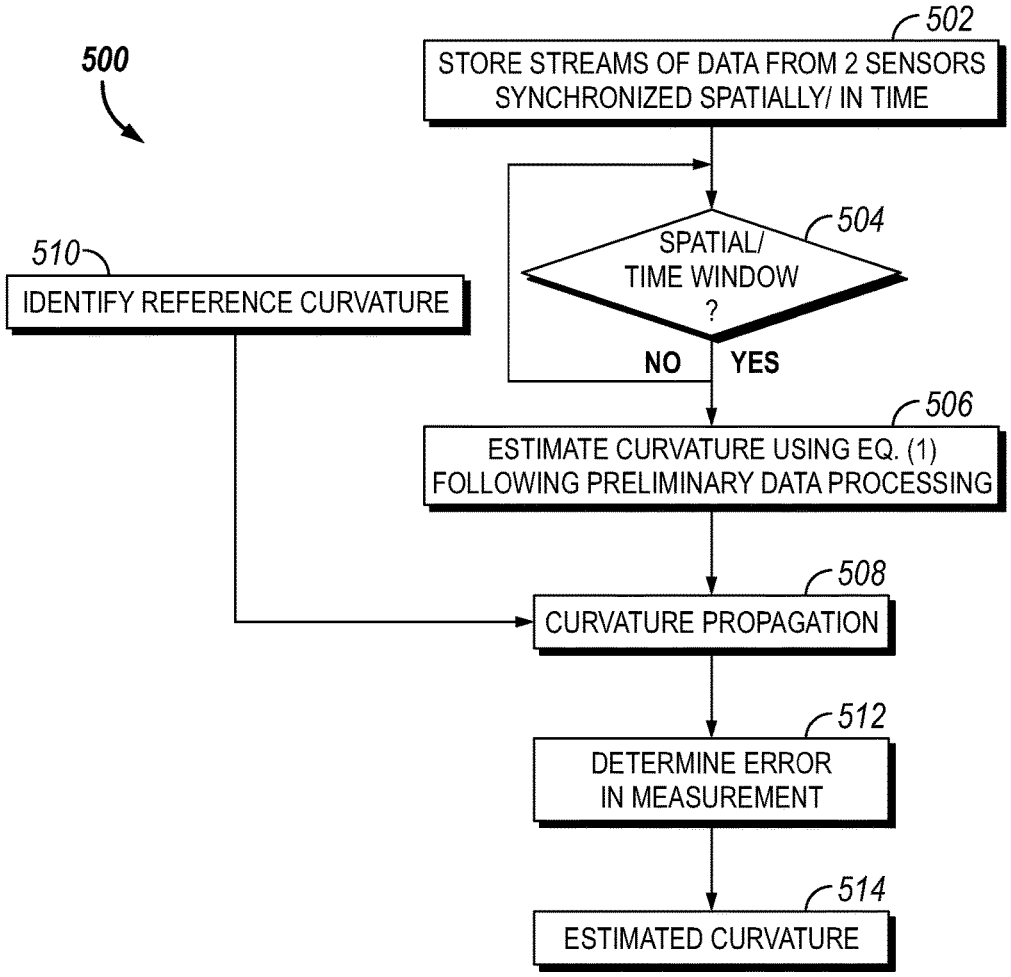
FIG. 5 is a workflow for curvature estimation.

FIG. 5 illustrates workflow 500 for curvature estimation, which may be implemented in block 412 (e.g., referring to FIG. 4) for curvature estimation. Workflow 500 may begin with block 502, in which data from the two or more sensors 136 (i.e., attitude measurements) may be synchronized spatially at a specific time and stored in information handling system 138 (e.g., referring to FIG. 1). From block 502 the workflow may move to block 504 to determine a spatial/time window. In block 504, attitude measurements taken by two or more sensors 136 are synced in either time and/or depth using information handling system 138 (e.g., referring to FIG. 1). Each of the two or more sensors 136 may be synced to use the calculations discussed below for workflow 500. This may allow for a curvature calculation. To sync the measurements at a time and/or depth a plurality of time stamps/depths corresponding to either of the two or more sensor 136 are found. They are then reviewed to determine is the "window" time and/or depth stamp matches the measurements form the two or more sensors 136. If measurements from the two or more sensors 136 are not aligned in an identified window, an interpolation may be performed so that the depths and/or time in the window match for the measurements for each of the two or more sensors 136. The measurements at those points may then be utilized to calculate the curvature. From block 504, workflow 500 may move to block 506.

In block 506, curvature estimation of the drilling path created by RSS 130 is performed. To perform the curvature estimation, attitude measurements from two or more sensors 136, which are placed at a distance L apart, are used. In block 506 the initial curvature signal is estimated by the following equation:

$$\kappa = \frac{\chi_{s1} - \chi_{s2}}{L} \tag{1}$$

where $$\chi = \begin{bmatrix} \theta \\ \phi \end{bmatrix}$$

denotes the wellbore attitude (inclination θ and azimuth ϕ) measurements in degrees for a first sensor 136 (i.e., disposed at drill bit 122) and a second sensor 136 (disposed at a distance L from first sensor 136 on BHA 134), and $$\kappa = \begin{bmatrix} BR \\ WR \end{bmatrix}$$

denotes a curvature rate of borehole 124 in an inclination plane (build rate, BR), and in an azimuthal plane (walk rate, WR). In block 508, a curvature propagation is formed by running an adaptive Kalman Filter to remove the uncertainty and error existing in the results from Equation (1) in block 506 by using a reference curvature in block 510. The reference curvature in block 510 is any reliable curvature information and may be selected by the user. For example, stationary survey measurements are less prone to noise and vibrations, therefore survey curvature can be used as the reference curvature. In block 512, the uncertainty and error are determined from the output of block 508. The error identification includes the uncertainty, noise and error in the calculated curvature in block 506. After determine error in block 512, subtract the error from the calculated curvature in 506 to get the corrected curvature block 514. The estimated curvature in block 514 may be sent to the curvature controller 402 to maintain the curvature set point $\text{Curve}_{set}$ 404.

TF and DC commands may be produced and sent to RSS 130 to alter the direction of RSS 130 in real-time during drilling operations to achieve the curvature set point.

Figure 6:
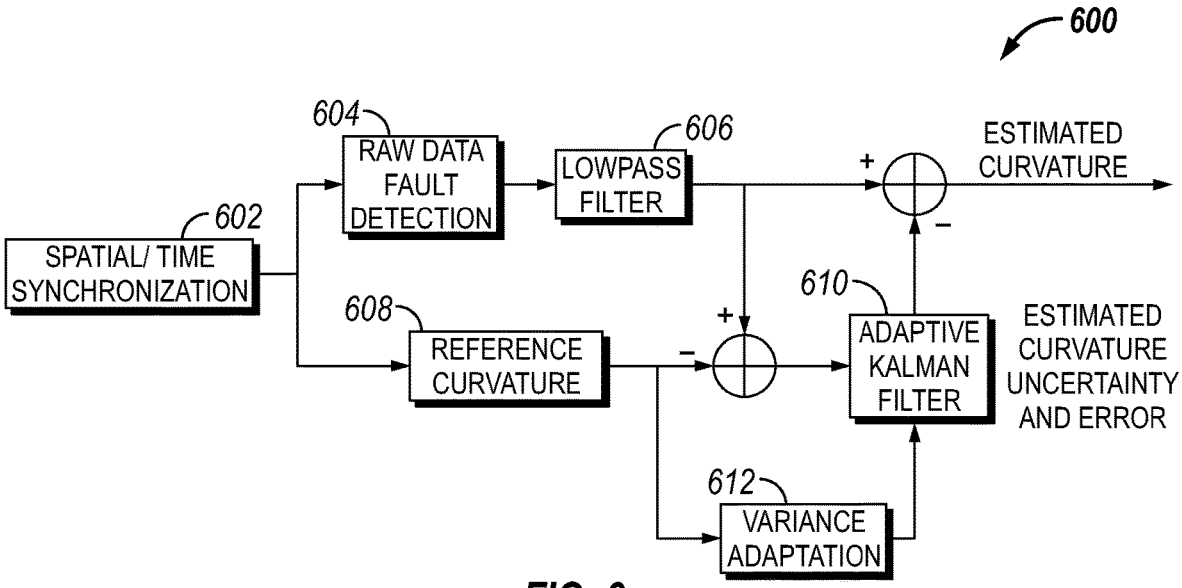
FIG. 6 is another workflow for curvature estimation.

As noted above, curvature estimation begins with measurements from one or more sensors 136 that take attitude measurements of the wellbore. Raw attitude measurements from one or more sensors 136 (e.g., referring to FIG. 1) may include large amounts of noise induced from drilling operations (e.g., referring to FIG. 1). FIG. 6 illustrates workflow 600 for another example of curvature estimation in the inclination plane (i.e., for block 412 in FIG. 4) by determining build rate. In examples, the curvature estimation may utilize a filter to remove noise recorded by the one or more sensors 136. Workflow 600 may begin with block 602 in which spatial/time synchronization is performed. Spatial/time synchronization is performed because in real-time control system, there are several reference time clocks. Different sensors possess data acquisition capability, for example, a first attitude sensor may provide 1000 Hz data, while a second attitude sensor may provide 500 Hz data. Thus, each of the two or more sensors 136 may or may not keep the same data acquisition capability. If the data update is not in the same frequency, data preprocessing (for example, data interpolation) may be utilized so that data in the calculation is collected at the same time point.

The output from block 602 may pass to block 604 in which fault detection may be applied to the raw data from block 602. Due to the complexity of drilling system 100 (e.g., referring to FIG. 1), measurement data provide by the two or more sensors 136 may not be trustable. For example, during the drilling process, some of the measurement data from each of the two or more sensors 136 may be corrupted. Measurements that may not be trustable are defined as fault data. In block 604 the fault data is detected and/or removed. Next, the data is sent to block 606, where a lowpass filter is applied to the data in block 604. For example, in block 606 a filter may be applied to a first attitude measurement from a first sensor 136 and a second attitude measurement from a second sensor 136 to form a filtered measurement set. The filtered measurement set may be sent to block 610 in which an estimated curvature uncertainty and error may be found.

Referring back to block 602, output from block 602 may be used in block 608 as a reference curvature. A reference curvature may be formed from a survey. A survey may deliver a reliable and trustworthy attitude information of the wellbore as it is taken while the tool is not drilling and thus, less susceptible to vibrations and noises. However, survey measurements are taken less frequent compared to the two or more sensors 136. In block 608, an algorithm may be utilized to detect whether new survey is coming in. The data from block 606, a filtered measurement set, and block 608 may be combined and passed to block 610, in which an adaptive Kalman filter is applied in block 610. In block 610, an estimated curvature uncertainty and error may be found. Generally, a conventional Kaman filter may be an efficient filtering tool to estimate the unknown or unmeasured state of a dynamic system from a series of noisy measurements. A conventional Kalman filter algorithm works by a two-step process. For the prediction step, the Kalman filter provides the estimation of the current state along with the uncertainty. In the correction step, once new sensor measurements may be available (i.e., from one or more sensors 136), the estimation is updated/corrected/filtered by computing and applying a calculated weight (Kalman gain). In the Kalman gain calculation process, covariance matrices are used to calculate/tune the filter. The output from block 610 and the output from block 606, both described above, may be compared to determine an estimated curvature.

Unlike current industrial applications, estimating the covariance of prediction and real measurement for the downhole drilling parameter is not an easy task, and it is highly dependent on geological and stratigraphic information, which is unavailable in real-time. Therefore, an adaptive law may be applied to predict the covariance of the data in real-time, in block 612, thus an adaptive Kalman Filter may be needed. In contrast, using a conventional Kalman Filter, all of the parameters used to calculate a Kalman gain are constant. However, as described in this disclosure, instead of using a constant, varying parameters may be implemented. Thus, an adaptive law in block 612 is one or more equations that express these varying parameters. In examples, the adaptive Kalman filter equation may be utilized to represent the covariance of real-time sensor data. Thus, the adaptive law is applied to the covariance of the data. This information is fed into block 610 as the second part of the adaptive Kalman filter. As the reference measurement, survey data, and the sensor measurements (i.e., from one or more sensors 136) have a fixed dynamic relationship. Survey data comprises initial and updated reliable measurement data for drilling system 100 (e.g., referring to FIG. 10. In general, survey data comprises depth, inclination, azimuth, build rate, walk rate, dogleg severity, and/or the like. Survey data is initiated, collected, and/or processed using information handling system 138 (e.g., referring to FIG. 1).

Figure 7:
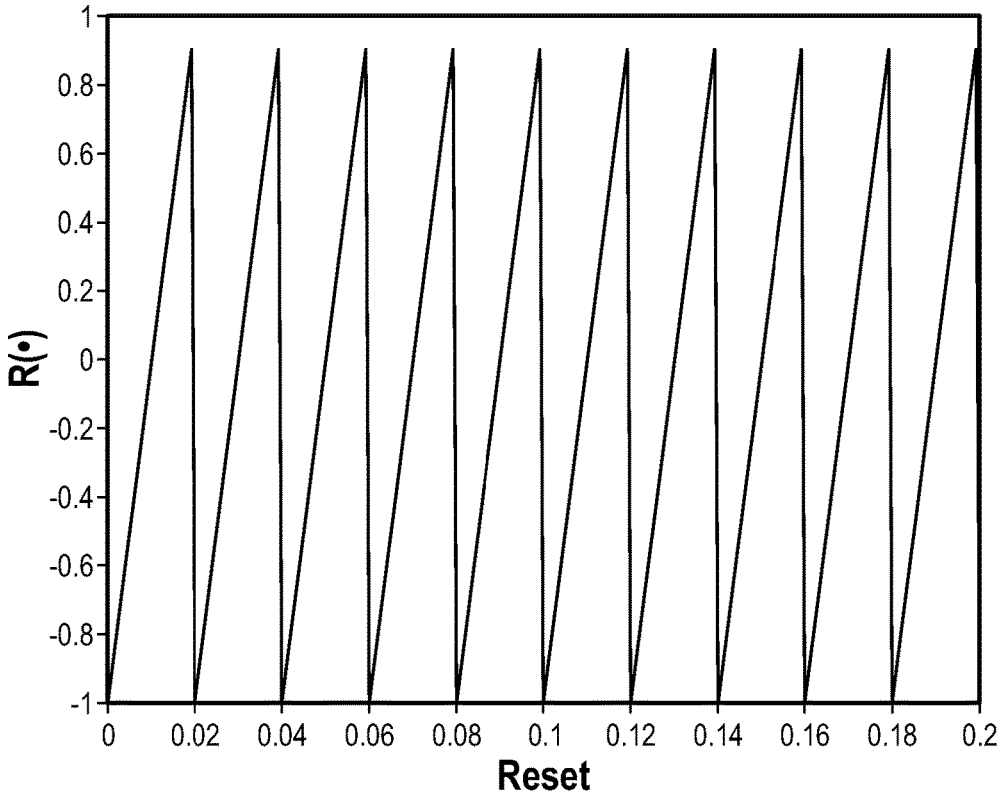
FIG. 7 is a graph showing a plurality of drilling intervals.

Additionally, in block 610, the adaptive Kalman filter may utilize a constant value for the process noise covariance matrix Q. This may be utilized while designing an adaptive law for the measurement noise covariance matrix R, to deal with the complex operating environment underground. Generally, while drilling and estimating the wellbore curvature, once a survey measurement is not received, the covariance of the measurement sensor data is different than the old survey data. Therefore, it is reasonable to use a time-varying function instead of a constant coefficient to represent the measurement noise covariance matrix R. FIG. 7 illustrates a graph in which during each drilling interval, N (between survey measurements), the measurement noise covariance matrix R(•) should be a large positive value which indicates the estimated curvature is highly depend on the measurements. At the point in which survey measurement is available, the measurement covariance R(•) changes to a small value, which means that the estimated curvature signal is dependent on the survey data more. Therefore, an internal signal, which may be defined as a reset signal, may represent the variety of the measurement covariance matrix R(•). The relationship between the measurement covariance R(•) and the reset signal (i.e., integral signal) may be similar to the sawtooth wave, as illustrated in FIG. 7

Referring back to FIG. 6, in the proposed adaptive Kalman filter of block 610, error may be estimated and removed from the filtered measurements set and the survey to form an estimated curvature signal, which may produce a smooth/corrected and reliable real-time curvature estimation, which is the output of block 610. The output of the utilized error estimation block may be a real-time estimation of curvature associated with a midpoint location between the first and second sensor 136. In examples, the midpoint location may be a location at or about an area that may be halfway between the first and second sensor 136. As discussed above, after determining error in block 610 such as with block 512, (e.g., referring to FIG. 5), instruction on correcting movement of RSS 130 to maintain the curvature set point $Curve_{set}$ 404 may be sent to RSS 130. For example, TF and DC instructions may be produced and sent to RSS 130 as illustrated in FIG. 4. In order to get a more accurate curvature estimation, a bit projection module may be utilized to estimate the instantaneous wellbore curvature at the drill bit location. The bit projection module uses a borehole propagation dynamic model to project the estimated wellbore curvature value corresponding to a midpoint location to the location of drill bit 122.

Figure 8:
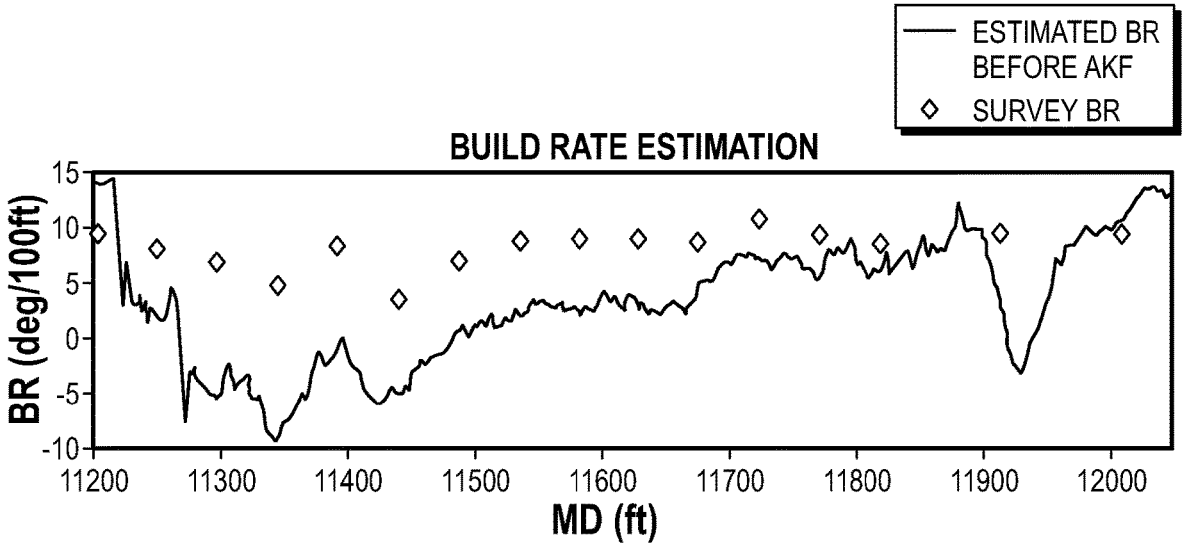
FIG. 8 is a graph illustrating real-time build rate.

FIG. 8 is an example result using workflows 500-700 discussed above to estimate the real-time build rate (wellbore curvature in the inclination plane). The graph illustrates an estimated build rate (BR) before an Adaptive Kalman Filter. Workflows 400-700 may consider the inclination angle from one or more sensors 136 (e.g., referring to FIG. 1) placed with at a known distance L on BHA 134. After the time/spatial synchronization, the inclination data from each sensor 136 may be used to estimate the raw build rate as shown by Eq (1). This raw signal is further processed and sent to the adaptive Kalman Filter.

Figure 9A:
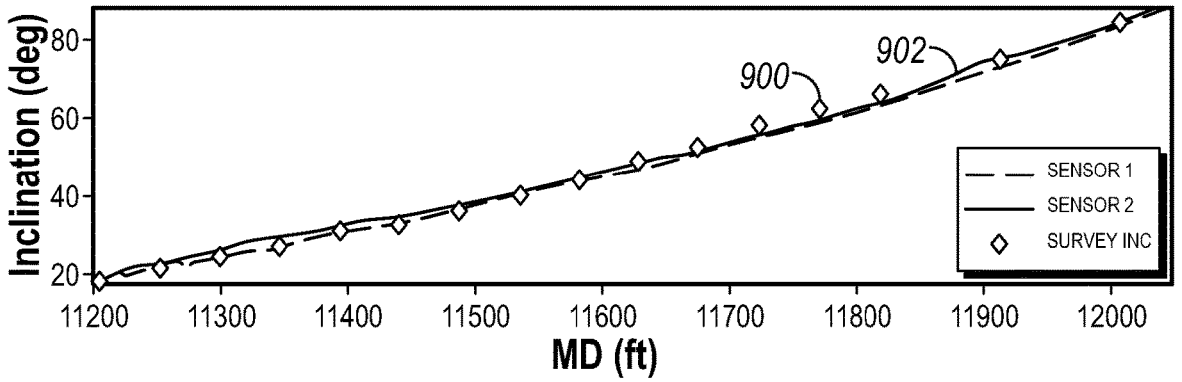
FIGS. 9A and 9B is a graph illustrating a plurality of curvature measurements.
Figure 9B:
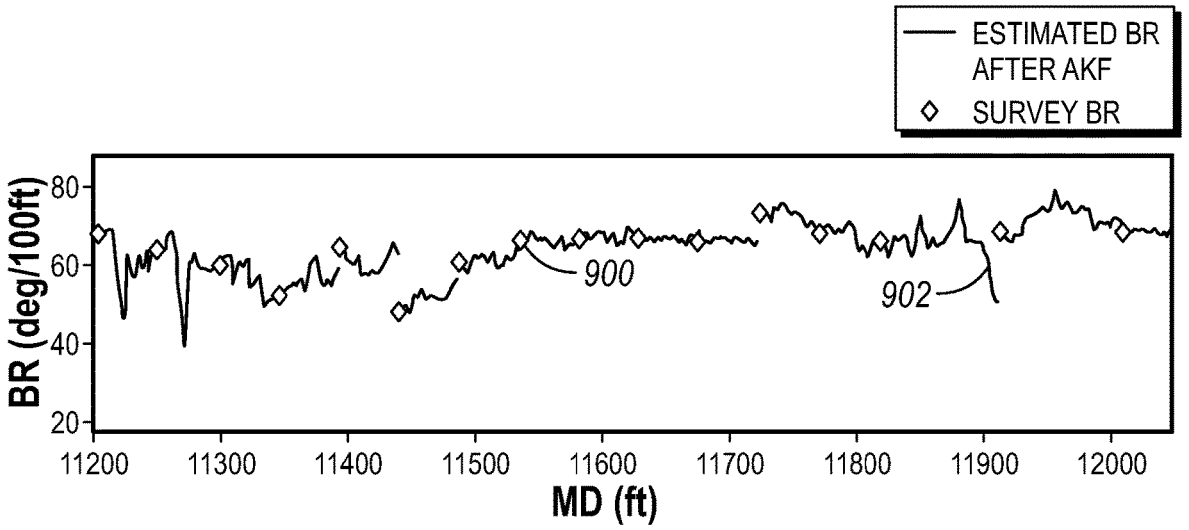

FIG. 9A is an example of the inclination measurements from the survey and two attitude sensors. FIG. 9B is the result of build rate (BR) estimation after Adaptive Kalman Filter using workflows 500-700 discussed above. Here, the survey BR is used as a reference to evaluate the accuracy of the estimation. For modes of operation with no access to survey data, a stable sensor 136 may be the reference signal. As shown in FIGS. 8, 9A and 9B, signal 902 is improved after undergoing filtering in workflows 500-700. The discontinuity in signal 902 in FIG. 9B may be explained by the resetting of removing of bad sensor data.

The methods and systems described above are an improvement over current technology. For example, having accurate and also reliable wellbore curvature information/signal in real-time (while drilling) may significantly improve the drilling automation and control performance while reducing computational computing. Moreover, such real-time curvature information will enhance our knowledge of borehole quality while drilling. Furthermore, such an estimation tool may further facilitate the smart autonomous directional drilling systems, which are capable of drilling complex well-plans with multiple curve sections without any driller intervention.

Additionally, the methods and systems introduce an advanced and yet reliable technique to accurately estimate the wellbore curvature signal in real-time. The proposed methodology is designed to utilize the already available sensor information, such as attitude signals from MWD sensors placed on BHA. The proposed curvature estimation algorithm will facilitate the design and implementation of highly efficient drilling automation systems and advanced controllers (both on surface and downhole), such as downhole curvature cruise control (designed to build the curved sections of wellbores autonomously). The systems and methods may include any of the various features of the systems and methods disclosed herein, including one or more of the following statements.

Statement 1. A method for estimating a wellbore curvature may comprise disposing a rotary steerable system (RSS) into a borehole, storing a real-time curvature estimation for the borehole in an information handling system, wherein the information handling system is disposed on the RSS, taking a first attitude measurement at a first sensor, and taking a second attitude measurement at a second sensor. The method my further comprise applying a filter to at least the first attitude measurement and the second attitude measurement to form a filtered measurement set, performing a curvature estimation with the filtered measurement set to form an estimated curvature signal, comparing the estimated curvature signal to the curvature set point to find a difference, and adjusting at least one operating parameter of the RSS based on the difference.

Statement 2. The method of statement 1, wherein the first sensor is disposed proximal a drill bit that is at least a part of the RSS.

Statement 3. The method of statement 2, wherein the second sensor is disposed on a bottom hole assembly (BHA) that is connected to the drill bit.

Statement 4. The method of statement 3, wherein a distance between the first sensor and the second sensor is known.

Statement 5. The method of any previous statements 1 or 2, further comprising calculating a wellbore curvature from the first attitude measurement and the second attitude measurement.

Statement 6. The method of statement 5, further comprising applying an adaptive Kalman filter to the wellbore curvature to form the estimated curvature signal.

Statement 7. The method of any previous statements 1, 2, or 5, further comprising applying an adaptive law to a first noise covariance of the first attitude measurement and a second noise covariance of the second attitude measurement.

Statement 8. The method of statement 7, further comprising applying the first noise covariance and the second noise covariance to the filtered measurement set.

Statement 9. The method of any previous statements 1, 2, 5, or 7, wherein the RSS is adjusted to achieve the curvature set point.

Statement 10. The method of any previous statements 1, 2, 5, 7, or 9, wherein the filter is a low pass filter.

Statement 11. The method of any previous statements 1, 2, 5, 7, 9, or 10, further comprising identifying if the first attitude measurement and the second attitude measurement are in a spatial window or a time window.

Statement 12. A system for estimating a wellbore curvature may comprise a rotary steerable system (RSS). The RSS may comprise a drill bit, a bottom hole assembly (BHA) connected to the drill bit, a first sensor disposed proximal the drill bit and configured to take a first attitude measurement, a second sensor disposed on the BHA and configured to take a second attitude measurement. The system may further comprise an information handling system disposed on the RSS and configured to store a real-time curvature estimation for a borehole, apply a filter to at least the first attitude measurement and the second attitude measurement to form a filtered measurement set, perform a curvature estimation with the filtered measurement set to form an estimated curvature signal, compare the estimating curvature signal to a curvature set point to find a difference, and adjust at least one operating parameter of the RSS based on the difference.

Statement 13. The system of statement 12, wherein a distance between the first sensor and the second sensor is known.

Statement 14. The system of any previous statements 12 or 13, wherein the information handling system is further configured to calculate a wellbore curvature from the first attitude measurement and the second attitude measurement.

Statement 15. The system of statement 14, wherein the information handling system is further configured to apply an adaptive Kalman filter to the wellbore curvature to form the estimated curvature signal.

Statement 16. The system of any previous statements 12-14, wherein the information handling system is further configured to apply an adaptive law to a first noise covariance of the first attitude measurement and a second noise covariance of the second attitude measurement.

Statement 17. The system of statement 16, wherein the information handling system is further configured to apply the first noise covariance and the second noise covariance to the filtered measurement set.

Statement 18. The system of any previous statements 12-14 or 16, wherein the RSS is adjusted to achieve the curvature set point.

Statement 19. The system of any previous statements 12-14, 16 or 18, wherein the filter is a low pass filter.

Statement 20. The system of any previous statements 12-14, 16, 18 or 19, wherein the information handling system is further configured to identify if the first attitude measurement and the second attitude measurement are in a spatial window or a time window.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method for estimating a wellbore curvature comprising:

disposing a rotary steerable system (RSS) into a borehole;

storing a real-time curvature estimation for the borehole in an information handling system, wherein the information handling system is disposed on the RSS;

taking a first attitude measurement at a first sensor;

taking a second attitude measurement at a second sensor;

applying a filter to at least the first attitude measurement and the second attitude measurement to form a filtered measurement set using a first noise covariance, wherein the first noise covariance is a time-varying function;

performing a curvature estimation with the filtered measurement set to form an estimated curvature signal, wherein the curve estimation is a difference between a first filtered attitude measurement and a second attitude measurement that is divided by a length between the first sensor and the second sensor;

comparing the estimated curvature signal to a curvature set point to find a difference, wherein the curvature set point is from a stationary survey measurement; and adjusting at least one operating parameter of the RSS based on the difference.

2. The method of claim 1, wherein the first sensor is disposed proximal a drill bit that is at least a part of the RSS.

3. The method of claim 2, wherein the second sensor is disposed on a bottom hole assembly (BHA) that is connected to the drill bit.

4. The method of claim 3, wherein the length between the first sensor and the second sensor is known.

5. The method of claim 1, further comprising calculating the wellbore curvature from the first attitude measurement and the second attitude measurement.

6. The method of claim 5, further comprising applying an adaptive Kalman filter to the wellbore curvature to form the estimated curvature signal.

7. The method of claim 1, further comprising applying an adaptive law to the first noise covariance of the first attitude measurement and a second noise covariance of the second attitude measurement.

8. The method of claim 7, further comprising applying the first noise covariance and the second noise covariance to the filtered measurement set.

9. The method of claim 1, wherein the RSS is adjusted to achieve the curvature set point.

10. The method of claim 1, wherein the filter is a low pass filter.

11. The method of claim 1, further comprising identifying if the first attitude measurement and the second attitude measurement are in a spatial window or a time window.

12. A system for estimating a wellbore curvature comprising:

a rotary steerable system (RSS) comprising:

a drill bit;

a bottom hole assembly (BHA) connected to the drill bit;

a first sensor disposed proximal the drill bit and configured to take a first attitude measurement;

a second sensor disposed on the BHA and configured to take a second attitude measurement; and an information handling system disposed on the RSS and configured to:

store a real-time curvature estimation for a borehole;

apply a filter to at least the first attitude measurement and the second attitude measurement to form a filtered measurement set using a first noise covariance, wherein the first noise covariance is a time-varying function;

perform a curvature estimation with the filtered measurement set to form an estimated curvature signal, wherein the curve estimation is a difference between a first filtered attitude measurement and a second attitude measurement that is divided by a length between the first sensor and the second sensor;

compare the estimating curvature signal to a curvature set point to find a difference, wherein the curvature set point is from a stationary survey measurement; and adjust at least one operating parameter of the RSS based on the difference.

13. The system of claim 12, wherein the length between the first sensor and the second sensor is known.

14. The system of claim 12, wherein the information handling system is further configured to calculate the wellbore curvature from the first attitude measurement and the second attitude measurement.

15. The system of claim 14, wherein the information handling system is further configured to apply an adaptive Kalman filter to the wellbore curvature to form the estimated curvature signal.

16. The system of claim 12, wherein the information handling system is further configured to apply an adaptive law to the first noise covariance of the first attitude measurement and a second noise covariance of the second attitude measurement.

17. The system of claim 16, wherein the information handling system is further configured to apply the first noise covariance and the second noise covariance to the filtered measurement set.

18. The system of claim 12, wherein the RSS is adjusted to achieve the curvature set point.

19. The system of claim 12, wherein the filter is a low pass filter.

20. The system of claim 12, wherein the information handling system is further configured to identify if the first attitude measurement and the second attitude measurement are in a spatial window or a time window.

* * * * *